United States Patent [19]

Spresny

[11] 4,059,864

[45] Nov. 29, 1977

[54] OVEN CLEANING IMPLEMENT

[76] Inventor: Sharon Spresny, 3197 Arnold Court, Bay City, Mich. 48706

[21] Appl. No.: 717,119

[22] Filed: Aug. 24, 1976

[51] Int. Cl.[2] ..... A47L 13/08

[52] U.S. Cl. ..... 15/105; 15/244 A

[58] Field of Search ..... 15/105, 244 R, 244 A, 15/143 B, 144 B, 118; 403/104, 290

[56] References Cited

U.S. PATENT DOCUMENTS

| | | | |
|---|---|---|---|
| 1,394,866 | 10/1921 | Schoenknecht | 403/290 X |
| 2,155,462 | 4/1939 | Anderson | 15/118 |
| 2,620,025 | 12/1952 | Powers | 403/290 |
| 2,740,146 | 4/1956 | Vaughn | 15/244 A |
| 3,023,438 | 3/1962 | Trentel | 15/244 R X |
| 3,199,139 | 8/1965 | Vallis | 15/118 X |

FOREIGN PATENT DOCUMENTS

| | | | |
|---|---|---|---|
| 554,773 | 2/1957 | Belgium | 15/244 A |
| 79,398 | 10/1962 | France | 15/244 R |

*Primary Examiner*—Edward J. McCarthy
*Attorney, Agent, or Firm*—Allen D. Brufsky

[57] ABSTRACT

A scrubbing implement for an oven including a handle having telescoping portions which are locked together in adjusted relation to conform to the overall depth of the oven, means for rotatably mounting the handle on an elongated base and clamping the handle at a relative angle to the base so the implement can be inserted in the oven at an angle precluding undue bending of the user, and a sponge removably mounted on the base for cleaning the oven. The use of the implement also removes the necessity of the user coming into contact with the interior of the oven while cleaning the oven, avoiding the accumulation of dirt on the clothes and hands.

4 Claims, 4 Drawing Figures

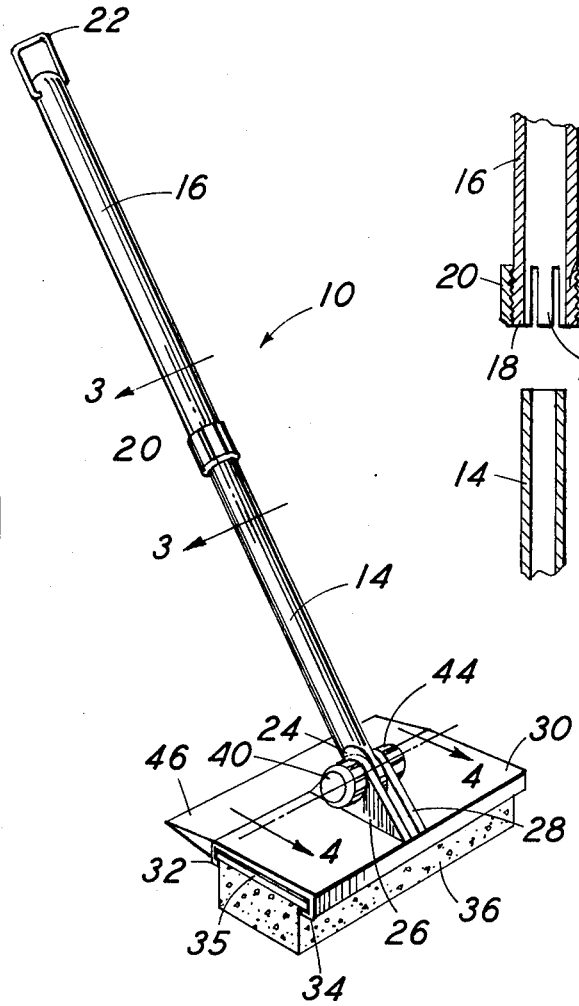
FIG. 1
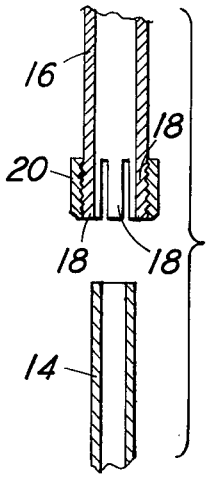
FIG. 3
FIG. 4
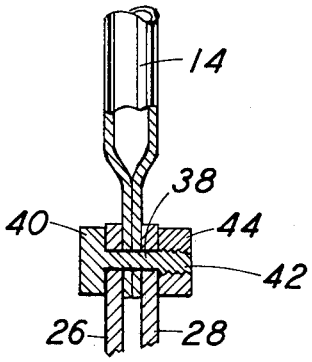
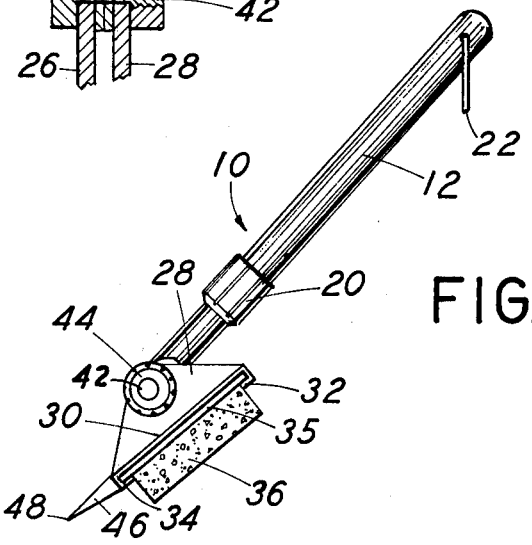
FIG. 2

OVEN CLEANING IMPLEMENT

BACKGROUND OF THE INVENTION

This invention relates to a cleaning implement for cleaning an oven.

The interior of an oven is cleaned by hand by a housewife repeatedly bending and scrubbing the oven with an abrasive pad or wiping the interior with a damp cloth or sponge after applying a cleanser. This invention provides an implement for reaching into the oven with a sponge to quickly and efficiently clean the interior thereof without undue and repeated bending and enables the user to reach even remote corners. Furthermore, the user need not come into contact with the over interior, avoiding the accumulation of grease and grime on hands and clothes.

SUMMARY OF THE INVENTION

In accordance with the invention, the implement includes a telescoping handle for adjusting the length of the implement to the overall depth of the oven. The outer telescoping portion of the handle has a terminal portion including a plurality of split fingers threadedly receiving a nut to clamp the handle portions in adjusted relation. The handle is rotatably mounted on a base wich slideably receives a replaceable cleaning sponge. The relative angle of the handle to the base may be adjusted to conform to the cleaning angle required to avoid insertion of the implement in the oven with undue bending. The adjusted angular relationship may be maintained by tightening a nut on the base to clamp the base to the handle. A scraper blade for scraping dried food from the oven wall is also provided on the base.

BRIEF DESCRIPTION OF THE DRAWING

Further objects and advantages of the invention will become apparent from the following description and claims, and from the accompanying drawing, wherein:

FIG. 1 is a perspective view of the oven cleaning implement of the invention;

FIG. 2 is a side view in elevation of the implement of FIG. 1;

FIG 3 is a cross-sectional view taken substantially along the plane indicated by line 3—3 of FIG. 1; and FIG. 4 is a cross-sectional view taken substantially along the plane indicated by line 4—4 of FIG. 1.

DETAILED DESCRIPTION OF THE PREFERRED EMBODIMENT

Referring now to the drawing in detail wherein like numerals indicate like elements throughout the several views, the cleaning implement 10 of the present invention includes an elongated, tubular handle 12 having a lower portion 14 telescopically received within an upper portion 16.

The lower terminal end of upper portion 16 of handle 12 includes a plurality of resilient split fingers 18 which includes threads about their circumference to threadedly receive a nut 20 having a knurled outer surface. Nut 20, when threaded onto fingers 18, clamps upper telescoping portion 16 to lower portion 14 in their relative adjusted relationship determining the overall length of handle 12. The upper terminal end of portion 16 includes a wire loop 22 or hanging implement 10 upon a hook or nail when stored and not in use.

The lower terminal end of lower portion 14 includes a flat surface 24 which is pivotably received between a pair of upright triangular plates 26, 28 on a base 30. Base 30 is substantially u-shaped in cross-section and has laterally extending flanges 32, 34 with lips extending inwardly towards each other from the legs of base 30. Slideably received and frictionally retained between flanges 32, 34 and the bight portion of base 30 is a plate 35 connected to a removable and replaceable plastic sponge 36.

The relative angle of handle 12 to base 30 may be adjusted by rotating flat 24 relative to plates 26, 28 and clamping the lower portion 14 of handle 12 in the adjusted angular position. A bolt 38 having a head 40 and threaded end 42 is received through plates 26, 28 and flat 24 and a clamping nut 44 on threaded end 42 is used to draw the bolt head 40 tight against plate 26 to clamp the flat 24 between plates 26 and 28.

A plastic or rubber scraper blade 46 having a sharpened edge 48 is integrally connected to one of the legs of base 30.

In use, the handle 12 is adjusted so that its overall length is sufficient to reach any depth of the oven to be cleaned. The relative angle of the handle 12 to base 30 is adjusted to conform to the cleaning angle required so the implement 10 can be inserted into the oven with a minimum of bending. Sponge 36 is then used to scrub the interior of the oven. Scraper blade 46 can be used to scrape off dried food and the like which sponge 36 cannot remove.

I claim:

1. An oven cleaning implement comprising:

An elongated tubular handle having an upper and lower telescoping portion, means on said handle for locking said upper and lower telescoping portions together in adjusted relation, said locking means including a plurality of resilient split fingers on a terminal end of said upper telescoping portion of said handle having configuous threads about their outer circumference, and a nut threadedly received on said fingers, an elongated base, means rotatably mounting the lower telescoping portion of said handle on said base, means between said base and lower telescoping portion of said handle for clamping said handle to said base.

said rotatable mounting means and clamping means including a pair of integrally formed upright plates on said base, an integrally formed flat on the lower terminal end of said lower telescoping portion of said handle received between said upright plates, a bolt having a threaded end received through said upright plates and flat, and a nut threadedly connected to the threaded end of said bolt, and a sponge removably mounted on said base.

2. An implement in accordance with claim 1 including a scraper blade attached to said base.

3. An implement in accordance with claim 1 wherein said base is substantially u-shaped in cross-section, providing a base and a pair of legs, and includes a pair of laterally extensive lips connected to the said legs with said lips extending inwardly towards each other for removeably receiving and frictionally retaining a plate connected to said sponge between the lips of said flanges and the bight of said base.

4. An implement in accordance with claim 1 including a wire loop on the upper terminal end of said upper telescoping portion of said handle.

* * * * *